US009147532B2

(12) United States Patent
Meftah et al.

(10) Patent No.: US 9,147,532 B2
(45) Date of Patent: Sep. 29, 2015

(54) EMERGENCY STOPPING DEVICE

(75) Inventors: Tewfik Meftah, Grenoble (FR); Dominique Benni, Mornac (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 62 days.

(21) Appl. No.: 14/112,445

(22) PCT Filed: Mar. 19, 2012

(86) PCT No.: PCT/EP2012/054781
§ 371 (c)(1),
(2), (4) Date: Oct. 17, 2013

(87) PCT Pub. No.: WO2012/143191
PCT Pub. Date: Oct. 26, 2012

(65) Prior Publication Data

US 2014/0042003 A1 Feb. 13, 2014

(30) Foreign Application Priority Data

Apr. 18, 2011 (FR) ..... 11 53337

(51) Int. Cl.
*H01H 3/02* (2006.01)
*H01H 25/06* (2006.01)

(52) U.S. Cl.
CPC ..... *H01H 3/022* (2013.01); *H01H 25/065* (2013.01); *H01H 2003/0246* (2013.01)

(58) Field of Classification Search
CPC ..... H01H 3/022; H01H 25/065; H01H 2003/0246
USPC ..... 200/43.04, 43.07, 16 A, 334
See application file for complete search history.

(56) References Cited

U.S. PATENT DOCUMENTS

| | | | | |
|---|---|---|---|---|
| 5,679,936 | A * | 10/1997 | Schaeffer et al. | 200/17 R |
| 6,444,932 | B1 | 9/2002 | Resmalm | |
| 8,089,012 | B2 * | 1/2012 | Mohtasham et al. | 200/61.18 |
| 2002/0134656 | A1 * | 9/2002 | Alain et al. | 200/341 |
| 2010/0243418 | A1 | 9/2010 | Machida et al. | |
| 2010/0323592 | A1 | 12/2010 | Nemetz et al. | |

FOREIGN PATENT DOCUMENTS

| | | |
|---|---|---|
| EP | 2 267 743 | 12/2010 |
| FR | 2 937 784 | 4/2010 |
| WO | 00 60621 | 10/2000 |

OTHER PUBLICATIONS

International Search Report Issued Jun. 1, 2012 in PCT/EP12/054781 Filed Mar. 19, 2012.

* cited by examiner

*Primary Examiner* — Edwin A. Leon
(74) *Attorney, Agent, or Firm* — Oblon, McClelland, Maier & Neustadt, L.L.P.

(57) ABSTRACT

The invention relates to an emergency stopping device, comprising a body (10), a control button (11) that is movable in translation along a control axis (X), at least one normally closed electrical contact unit (13), an actuation member (12) which can be actuated by said control button (11) so as to translate between a inoperative position and an actuated position, and which engages with the contact unit (13), a holding member (121) engaging with the actuation member (12) and capable of assuming a locking position for maintaining the actuation member in the actuated position thereof, and an unlocking ring (15) which is separate from the control button and which can be rotatably actuated, and which engages with the actuation member (12) so as to release the latter with a view to driving same toward the inoperative position thereof.

14 Claims, 6 Drawing Sheets

EMERGENCY STOPPING DEVICE

TECHNICAL FIELD OF THE INVENTION

The present invention relates to an emergency stopping device with a particularly compact architecture.

PRIOR ART

Today, a known emergency stopping device as described for example in document U.S. Pat. No. 7,790,996 comprises a control button which is movable in translation along a control axis between two positions and is able to actuate a pusher which cooperates with an electrical contact unit. To unlock such emergency stopping devices, the control button is actuated in rotation. In order to be easily handled, the button must have a shape enabling it to be grasped easily in relation to the rest of the device. It therefore often assumes a particularly protruding form which increases its depth dimension.

Document EP 2267743 describes an electrical switch comprising an actuator formed by a rotary ring which is movable between an inoperative position and an actuated position in which it is held locked, a cam intended to be driven in rotation by the rotary ring in order to act on a microswitch controlling an electrical circuit, and a safety button which can be actuated by axial pressure with the aim of releasing the rotary ring in order to bring it towards its inoperative position and thus open the electrical circuit. In this architecture, the button does not remain held in its actuated position and it is not therefore necessary to unlock it after actuation.

DISCLOSURE OF THE INVENTION

The aim of the invention is to propose an emergency stopping device in which the control button remains held in its actuated position, said device having a reduced depth dimension.

This aim is achieved by an emergency stopping device comprising a body, a control button which is movable in translation along a control axis, at least one electrical contact unit of the normally closed type, an actuation member which can be actuated in translation by said control button between an inoperative position and an actuated position and cooperating with the contact unit, a holding member cooperating with the actuation member and able to assume a locking position in order to hold the actuation member in its actuated position, characterized in that it comprises an unlocking ring which can be actuated in rotation and cooperates with the actuation member to release it with the aim of driving it towards its inoperative position.

According to one feature, the unlocking ring rotates as one with the control button and is fitted in a manner coaxial to the control button.

According to another feature, the device comprises an opening spring arranged between the control button and the actuation member.

According to another feature, the device comprises a release member cooperating with the actuation member and with the body and comprising a stop position in which it holds the actuation member in its inoperative position and an actuated position in which it releases the actuation member under the action of the opening spring.

According to another feature, the control button is movable between two end positions, an inoperative position and an actuated position in which the control button comes to rest against a fixed stop of the housing.

According to another feature, the contact unit is fitted on a printed circuit of annular form fitted on the body.

According to another feature, the device comprises a lighting assembly fitted on the printed circuit.

According to another feature, the device comprises a guide rod which is oriented along the control axis and passes through the printed circuit and the actuation member and is inserted in an axial housing of the control button.

According to another feature, the contact unit comprises a movable contact bridge with axial actuation.

According to another feature, the contact unit comprises a movable contact bridge with radial actuation in relation to the control axis.

According to another feature, the contact unit comprises a pusher and the actuation member comprises a lug able to cooperate with said pusher.

According to another feature, the body is fitted on a housing consisting of a flush-mounted box which can be inserted in an opening made in a wall.

According to another feature, the body is fitted on a housing mounted in a manner protruding from a wall.

BRIEF DESCRIPTION OF THE FIGURES

Other characteristics and advantages will become apparent from the detailed description below which refers to an embodiment given as an example and represented by the attached drawings in which.

DETAILED DESCRIPTION OF AT LEAST ONE EMBODIMENT

In a known manner, an emergency stopping device is intended to control an electrical circuit and can be actuated by an operator in order to open the electrical circuit in case of emergency.

Figure 1:
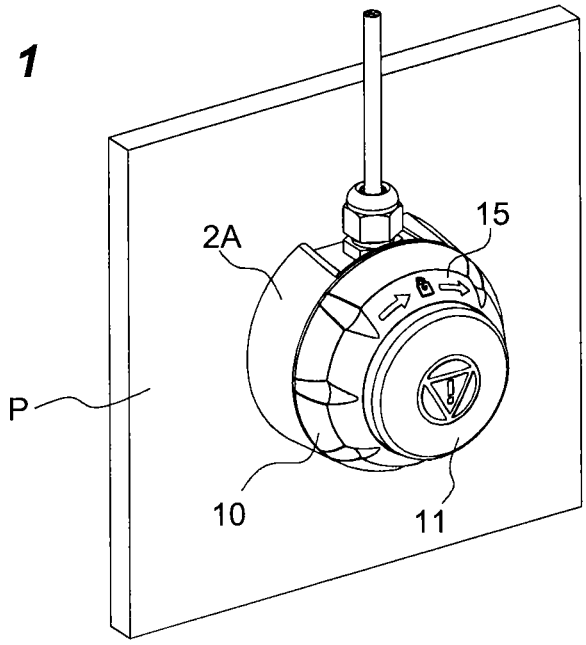
FIG. 1 shows the emergency stopping device according to the invention mounted in a manner protruding from a wall.
Figure 2:
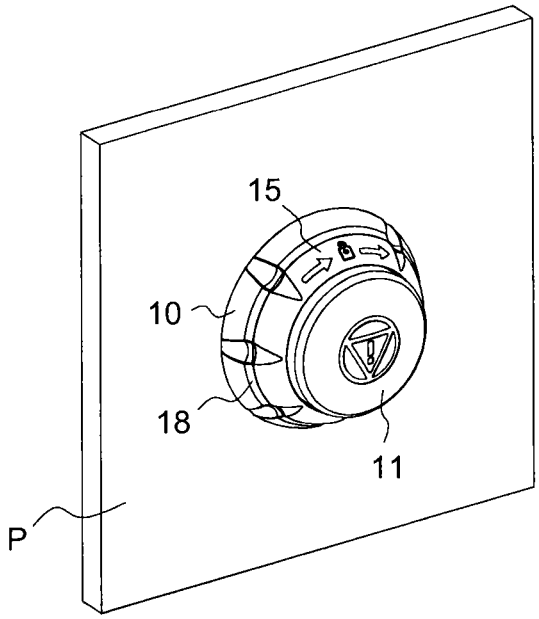
FIG. 2 shows the emergency stopping device according to the invention built into a wall.
Figure 3:
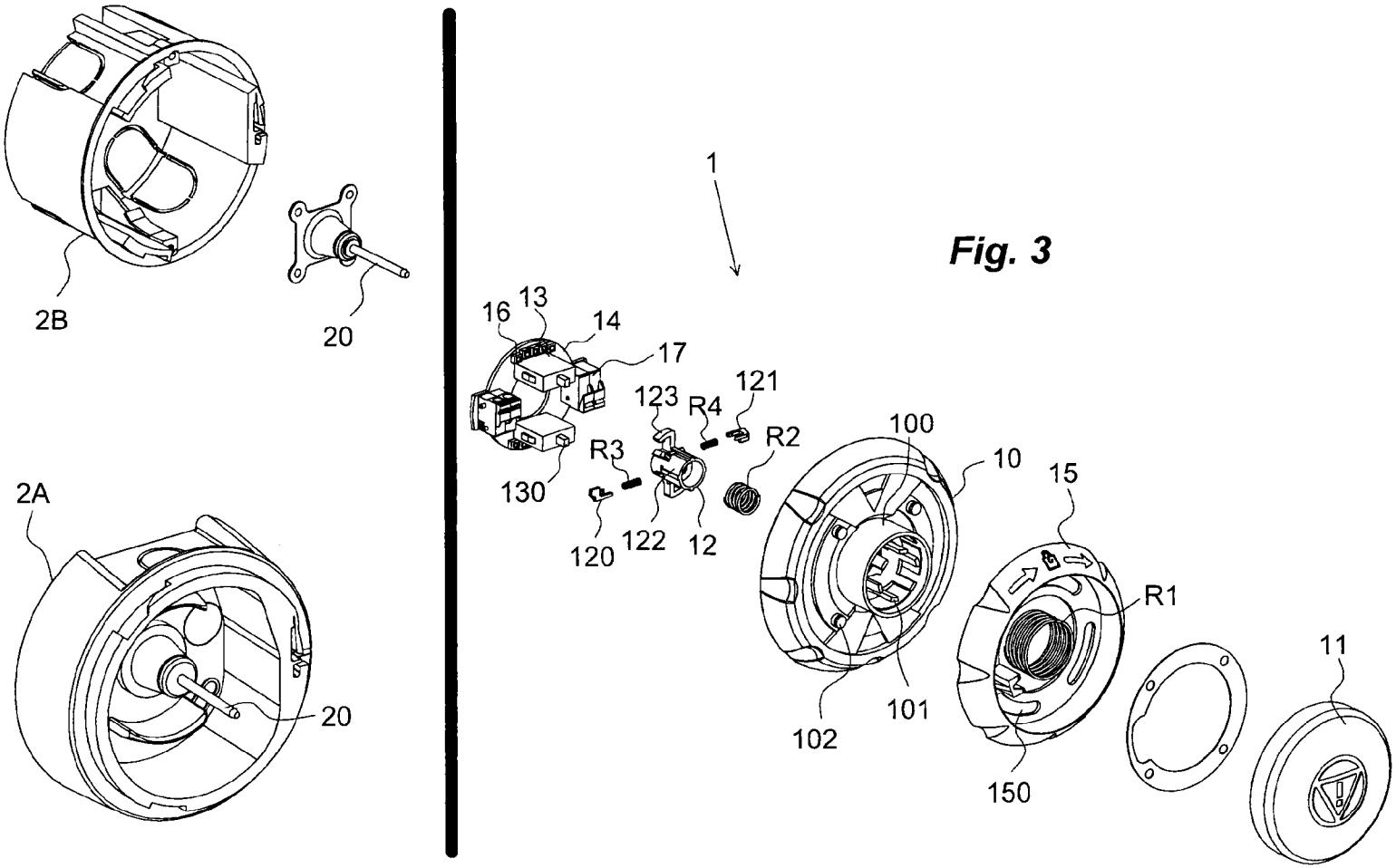
FIG. 3 shows an exploded view of the emergency stopping device according to the two configurations shown in FIGS. 1 and 2, FIGS. 4A, 5A, 6A and 7A show, in longitudinal axial section, the emergency stopping device according to the invention in which the control button is respectively in the inoperative position, in the actuated position at the stop, in the actuated released position, and in the inoperative position after unlocking.

The emergency stopping device of the invention can assume two distinct configurations depending on whether it is mounted in a manner protruding from a wall P (FIG. 1) or is built into the wall (FIG. 2). For both configurations, it comprises a common architecture which is fitted either on a housing 2A protruding from the wall P or on a housing 2B built into the wall P (not visible in FIG. 2). The common architecture consists of a control assembly 1 intended to be fixed to the housing 2A, 2B and comprising a body 10.

The body 10 is for example circular in form and comprises a central opening. The body also has a cylindrical collar 100 produced on the periphery of the central opening, an internal cylindrical sleeve 101 and a dish 102 defined between the collar 100 and the sleeve 101.

The control assembly 1 of the emergency stopping device also comprises a movable control button 11 which is able to move along a control axis (X), and a helical return spring R1 housed in the dish 102 and stressed along the control axis (X) by the control button 11 against the body 10. The control button 11 is initially in an inoperative position (FIGS. 4A and 4B) in which the electrical circuit controlled is closed. By pressure towards the interior of the device, the control button 11 can be brought into an actuated position (FIGS. 5A and 5B) in which it comes to rest against the body, thus allowing the electrical circuit to open in a positive manner. After actuation, the control button 11 is released but then remains held in an actuated position (FIGS. 6A and 6B) in which the electrical circuit remains open. The electrical circuit remains open until the device is unlocked.

Figure 4A:
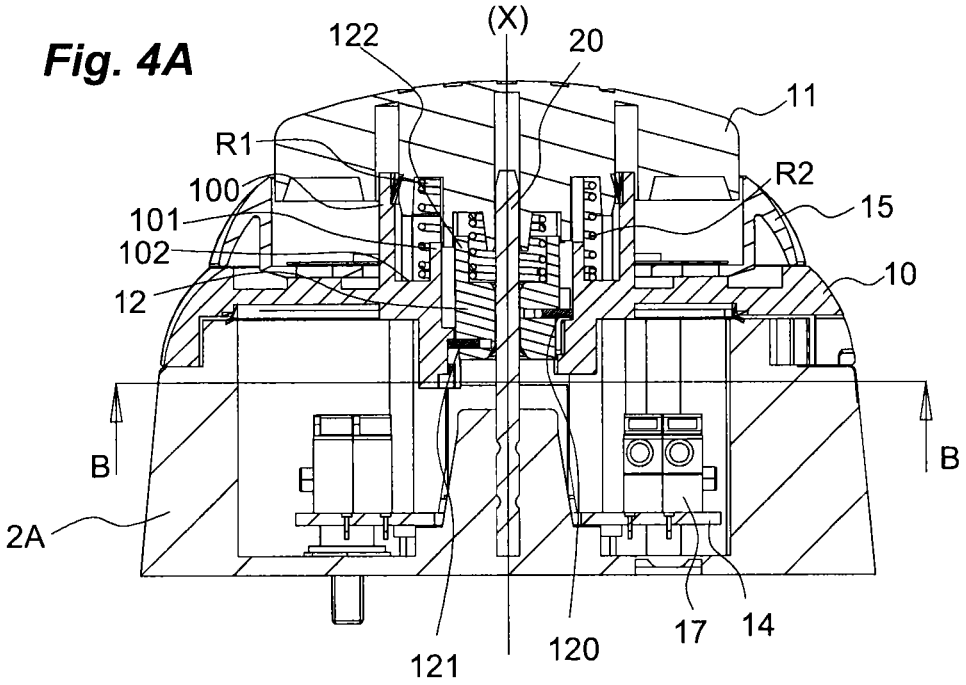
FIGS. 4B, 5B, 6B and 7B show respective cross sections along line B-B of the devices shown in FIGS. 4A, 5A, 6A and 7A.
Figure 4B:
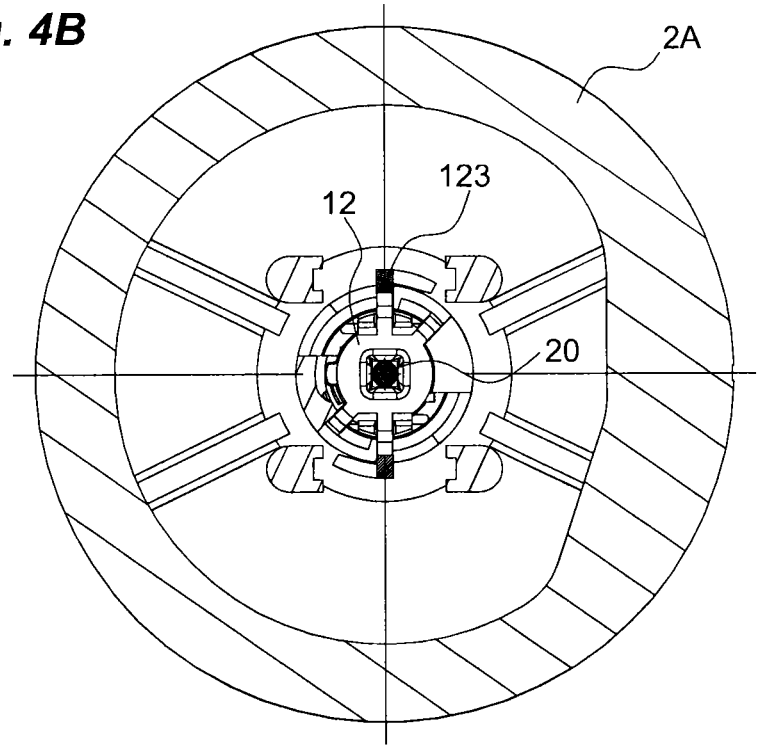
Figure 5A:
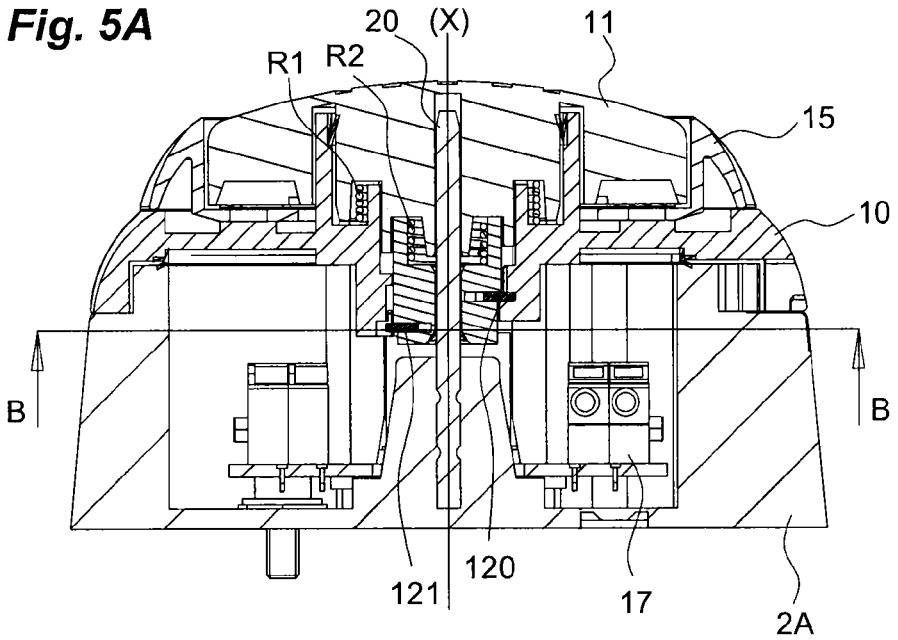
Figure 5B:
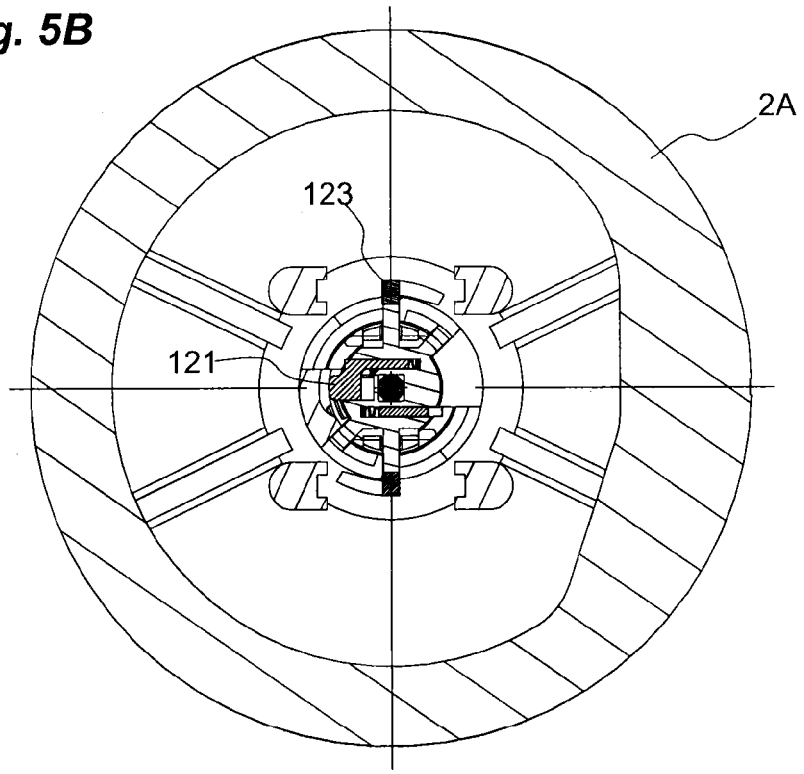
Figure 6A:
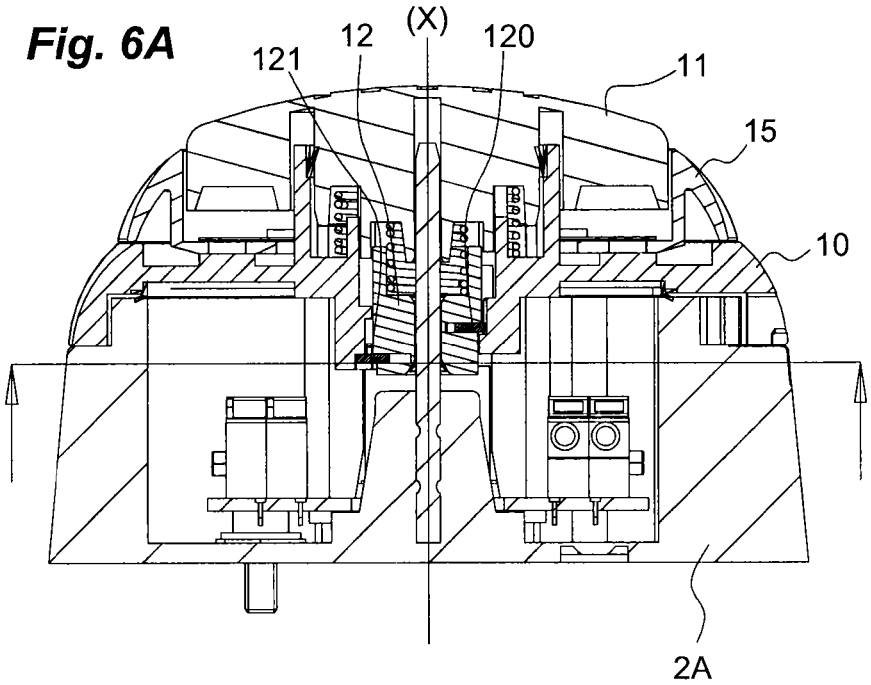
Figure 6B:
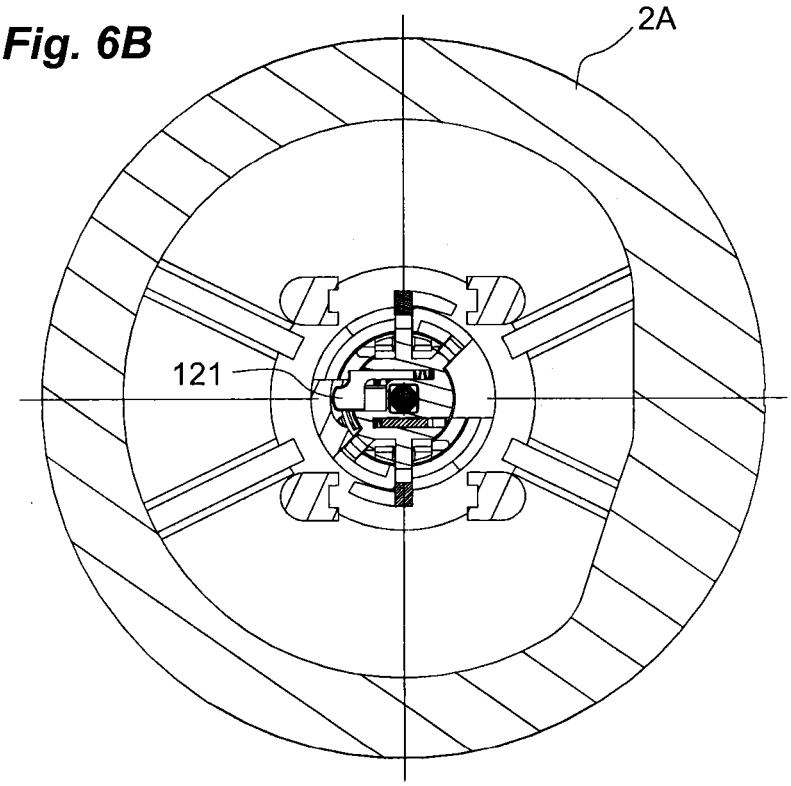
Figure 7A:
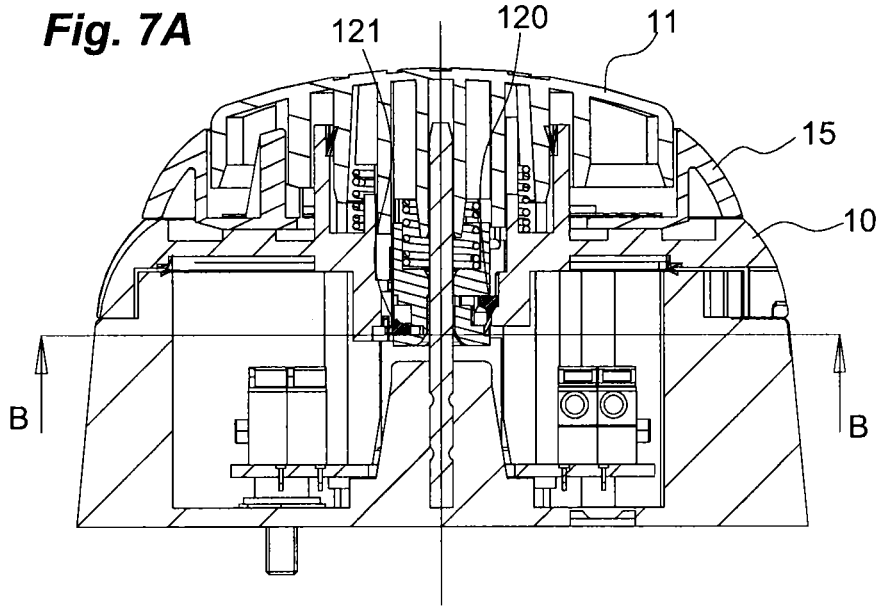
Figure 7B:
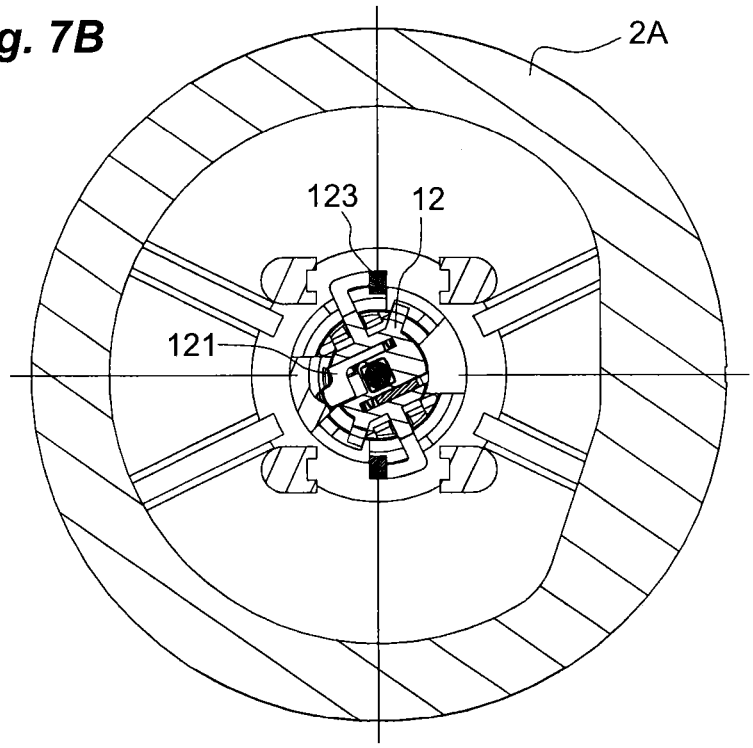

The control assembly 1 of the emergency stopping device according to the invention comprises an actuation member 12 attached to the control button 11 via fixing elements produced on the control button 11. The actuation member 12 comprises an axial central bore and a collar 122 situated on the periphery of said bore, defining a seat intended to receive an opening spring R2 which rests at one end against the actuation member 12 and at the other against the control button 11. The actuation member 12 is stressed in translation along the control axis by the opening spring R2 against the fixing elements of the control button 11. The control button 11 and the actuation member 12 can move freely in translation towards each other by compression of the opening spring R2. When the control button 11 is in the inoperative position, the actuation member 12 is in an inoperative position (FIGS. 4A and 4B). When a pressure is exerted on the control button 11 towards its actuated position, the actuation member 12 initially remains in its inoperative position (FIGS. 5A and 5B), which causes a compression of the opening spring R2 to store energy. When the opening spring R2 is sufficiently compressed, the actuation member 12 is suddenly released, driven by the energy stored in the opening spring R2. The actuation member 12 is then in its actuated position (FIGS. 6A and 6B). After actuation, the actuation member 12 remains held in its actuated position and, via the fixing elements, holds the control button 11 in its actuated position towards the interior of the body 10. If the control button is released, it remains in the actuated position. Unlocking is then necessary in order to return the control button and actuation member to their inoperative positions (FIGS. 7A and 7B).

The control assembly 1 of the emergency stopping device also comprises a release member 120 and a holding member 121, each composed for example of a finger which is received in a radial housing made in the actuation member 12. Each of these two members is mounted on a helical spring R3, R4 so as to be able to move radially in relation to the control axis (X). The release member 120 and the holding member 121 are positioned such that they can each cooperate with the body 10 depending on the position of the control button 11. The release member 120 and the holding member 121 are able to move along two separate, parallel planes perpendicular to the control axis (X). The translation plane of the release member 120 is located above the translation plane of the holding member 121. On the inner surface of its central opening, the body 10 comprises cam forms intended to be followed by the release member 120 and the holding member 121, enabling each of these bodies to fulfill its function. The release member 120 cooperates with the body 10 to hold the actuation member 12 in its inoperative position until sufficient energy has been stored in the opening spring R2. When the control button is sufficiently depressed, under the action of a cam form produced on the body 10, the release member 120 retracts into its housing to release the actuation member 12 under the action of the opening spring R2. The actuation member 12 then also holds the control button 11 in the actuated position towards the interior of the body 10. The holding member 121 cooperates with a stop made on the body 10 to allow the actuation member 12 to engage on the body when the control button 11 is depressed into its actuated position, and thus hold the actuation member 12 and the control button 11 in their actuated positions.

The control assembly 1 of the device comprises at least one electrical contact unit 13, generally two electrical contact units to ensure redundancy on actuation of the device. Each electrical contact unit comprises a set of normally closed electrical contacts (NC contacts). The two electrical contact units 13 are for example fitted on a printed circuit 14, for example in annular form, fixed to the body 10. Each contact unit 13 comprises for example a pusher 130 integral with a movable contact bridge which is intended to be actuated axially by the actuation member 12. For this, the actuation member 12 is equipped with two lugs 123 extending towards the outside in opposing radial directions. Each lug 123 is arranged so that it can rest on a pusher 130 of a separate contact unit 13 when the actuation member 12 is driven by the opening spring R2 towards its actuated position. In a variant embodiment, the contact unit can comprise a movable contact bridge with radial actuation in relation to the control axis. This variant embodiment in particular allows an even more compact construction.

The control assembly 1 of the emergency stopping device comprises an unlocking ring 15 which is separate from the control button and fixed to the body 10 and movable in rotation in relation thereto. The unlocking ring 15 is arranged on the periphery of the control button 11 and cooperates in rotation with the control button 11 to unlock it. Rotational guidance means 150 are produced on the unlocking ring 15 and cooperate with studs 102 produced on the body 10. On rotation, the unlocking ring 15 drives the control button 11 in rotation which in turn drives the actuation member 12 in rotation. Rotation of the actuation member 12 releases the holding member 121 from the stop produced on the body 10 and, under the action of the return spring R1, allows the control button 11 and hence the actuation member 12 to return to their inoperative positions. Use of an unlocking ring 15 separate from the control button 11 means that a device with a particularly compact architecture can be proposed.

The emergency stopping device comprises a lighting assembly which is fully integrated in the device and fitted on the printed circuit 14, and which is intended to perform the function of a luminous signal for the emergency stopping device. This lighting assembly comprises a plurality of light-emitting diodes 16 connected to supply units 17 welded to the printed circuit 14. The lighting assembly is for example controlled to illuminate the emergency stopping device in green or red depending on the operating state of the latter. Light guides can be provided through the body 10 and the unlocking ring to allow the light from the lighting assembly to pass through, and a transparent crown 18 allowing the light from the diodes to pass towards the outside can be provided between the unlocking ring 15 and the body 10 of the device.

Furthermore, to increase the rigidity of the device structure and to guide the control button 11 in translation, a guide device for the elements of the device can be provided. This guide device comprises a rod 20, for example made of metal, comprising a first end fixed to the base of the housing 2A, 2B and extending along the control axis (X) through the printed circuit 14, the central bore of the actuation member 12 and the opening spring R2, and a second end being received in a housing produced in the control button 11.

The invention claimed is:

1. An emergency stopping device comprising a body, a control button which is movable in translation along a control axis, at least one electrical contact unit of the normally closed type, an actuation member which can be actuated in translation by said control button between an inoperative position and an actuated position in order to act on the contact unit, a holding member cooperating with the actuation member and able to assume a locking position in order to hold the actuation member in its actuated position, characterized in that when the holding member is in the locking position, the holding member holds the control button in an actuated position, and in that the emergency stopping device comprises an unlocking ring which can be actuated in rotation and cooperates with the actuation member to release it with the aim of driving it towards its inoperative position.

2. The device as claimed in claim 1, characterized in that the unlocking ring rotates as one with the control button and is fitted in a manner coaxial to the control button.

3. The device as claimed in claim 1, characterized in that it comprises an opening spring arranged between the control button and the actuation member.

4. The device as claimed in claim 3, characterized in that it comprises a release member cooperating with the actuation member and with the body and comprising a stop position in which it holds the actuation member in its inoperative position and an actuated position in which it releases the actuation member under the action of the opening spring.

5. The device as claimed in claim 1, characterized in that the control button is movable between two end positions, an inoperative position and the actuated position in which the control button comes to rest against a fixed stop of the housing.

6. The device as claimed in claim 1, characterized in that the contact unit is fitted on a printed circuit of annular form fitted on the body.

7. An emergency stopping device comprising a body, a control button which is movable in translation along a control axis, at least one electrical contact unit of the normally closed type, an actuation member which can be actuated in translation by said control button between an inoperative position and an actuated position in order to act on the contact unit, a holding member cooperating with the actuation member and able to assume a locking position in order to hold the actuation member in its actuated position, characterized in that it comprises an unlocking ring which can be actuated in rotation and cooperates with the actuation member to release it with the aim of driving it towards its inoperative position, in that the contact unit is fitted on a printed circuit of annular form fitted on the body, and in that it comprises a lighting assembly fitted on the printed circuit.

8. An emergency stopping device comprising a body, a control button which is movable in translation along a control axis, at least one electrical contact unit of the normally closed type, an actuation member which can be actuated in translation by said control button between an inoperative position and an actuated position in order to act on the contact unit, a holding member cooperating with the actuation member and able to assume a locking position in order to hold the actuation member in its actuated position, characterized in that it comprises an unlocking ring which can be actuated in rotation and cooperates with the actuation member to release it with the aim of driving it towards its inoperative position, in that the contact unit is fitted on a printed circuit of annular form fitted on the body, and in that it comprises a guide rod which is oriented along the control axis and passes through the printed circuit and the actuation member and is inserted in an axial housing of the control button.

9. The device as claimed in claim 1, characterized in that the contact unit comprises a movable contact bridge with axial actuation.

10. The device as claimed in claim 1, characterized in that the contact unit comprises a movable contact bridge with radial actuation in relation to the control axis.

11. The device as claimed in claim 9, characterized in that the contact unit comprises a pusher and in that the actuation member comprises a lug able to cooperate with said pusher.

12. The device as claimed in claim 1, characterized in that the body is fitted on a housing consisting of a flush-mounted box which can be inserted in an opening made in a wall.

13. The device as claimed in claim 1, characterized in that the body is fitted on a housing mounted in a manner protruding from a wall.

14. The device as claimed in claim 1, characterized in that the holding member comprises a finger that is mounted on a spring so as to be able to move radially in relation to the control axis.

* * * * *